US008240088B2

(12) United States Patent
Tarrega Lloret

(10) Patent No.: US 8,240,088 B2
(45) Date of Patent: Aug. 14, 2012

(54) REGULATION MECHANISM FOR SLIDING DOORS

(75) Inventor: Miguel Angel Tarrega Lloret, Barcelona (ES)

(73) Assignee: Klein Iberica, S.A., Barcelona (ES)

( * ) Notice: Subject to any disclaimer, the term of this patent is extended or adjusted under 35 U.S.C. 154(b) by 682 days.

(21) Appl. No.: 12/265,036

(22) Filed: Nov. 5, 2008

(65) Prior Publication Data

US 2009/0119998 A1 May 14, 2009

(51) Int. Cl.
*E05D 13/00* (2006.01)

(52) U.S. Cl. ..... 49/404; 49/409; 49/410; 49/411; 49/505; 49/323; 16/82

(58) Field of Classification Search ..... 312/207, 312/204.51; 52/334.23–334.34, 349, 350, 52/304, 139.2; 16/82, 83, 85, 58; 49/323, 49/409, 410, 411, 412, 404, 505, 472
See application file for complete search history.

(56) References Cited

U.S. PATENT DOCUMENTS

| | | | | | |
|---|---|---|---|---|---|
| 627,991 | A * | 7/1899 | Ensign | 16/105 |
| 1,042,927 | A * | 10/1912 | King | 16/105 |
| 1,627,579 | A * | 5/1927 | Stevens | 49/323 |
| 2,085,832 | A * | 7/1937 | Shochet | 312/139.2 |
| 2,088,866 | A * | 8/1937 | Patterson | 49/70 |
| 2,907,078 | A * | 10/1959 | Hahn | 49/409 |
| 3,466,698 | A * | 9/1969 | Nystrom | 16/87 R |
| 3,555,591 | A * | 1/1971 | Sogoian | 16/49 |
| 4,574,524 | A * | 3/1986 | Bonetti et al. | 49/130 |
| 4,674,232 | A * | 6/1987 | Rosada | 49/425 |
| 4,821,456 | A * | 4/1989 | Nogaki | 49/362 |
| 4,868,935 | A * | 9/1989 | Van Weelden | 4/610 |
| 5,272,839 | A * | 12/1993 | Karhu | 49/409 |
| 5,313,739 | A * | 5/1994 | Nelson et al. | 49/404 |
| 5,689,853 | A * | 11/1997 | Lemmer | 16/82 |
| 5,826,377 | A * | 10/1998 | Simson et al. | 49/362 |
| 5,873,205 | A * | 2/1999 | Hanlon et al. | 52/239 |
| 6,324,789 | B1 * | 12/2001 | Stephen | 49/362 |
| 6,393,772 | B1 * | 5/2002 | McRoberts et al. | 52/64 |
| 6,691,465 | B1 * | 2/2004 | Stephan | 49/404 |
| 6,895,714 | B2 * | 5/2005 | Teubert et al. | 49/505 |

(Continued)

FOREIGN PATENT DOCUMENTS

DE 32 08 847 9/1983

(Continued)

OTHER PUBLICATIONS

European Search Report for corresponding EP Application No. 08 38 0297 dated Aug. 27, 2010.

*Primary Examiner* — Katherine W Mitchell
*Assistant Examiner* — Marcus Menezes
(74) *Attorney, Agent, or Firm* — Merchant & Gould P.C.

(57) ABSTRACT

The invention relates to a regulation mechanism for built-in sliding doors of the type comprising a sliding leaf (4), a guide (6) in the lower part of said sliding leaf (4) and a fixed stop (16) inside said guide (6), comprising a cover (1) fixed at the end of the sliding leaf (4), a mobile stop (2) slidable through the inner part of the guide (6) situated between the cover (1) and the fixed stop (16), and an adjustment screw (3) traversing the cover (1) and the mobile stop (2) by means of which the relative position between both elements (1) and (2) is regulated.

3 Claims, 4 Drawing Sheets

U.S. PATENT DOCUMENTS

| | | | | |
|---|---|---|---|---|
| 7,013,605 | B2 * | 3/2006 | Zhou et al. | 52/30 |
| 7,430,832 | B2 * | 10/2008 | Hung | 49/404 |
| 7,555,871 | B1 * | 7/2009 | Neal | 52/204.51 |
| 7,743,557 | B2 * | 6/2010 | Liao | 49/409 |
| 7,865,999 | B2 * | 1/2011 | Hilger | 16/65 |
| 2004/0003556 | A1 | 1/2004 | Zerbst | |
| 2005/0235571 | A1 * | 10/2005 | Ewing et al. | 49/410 |
| 2006/0230683 | A1 * | 10/2006 | Hung | 49/409 |
| 2006/0230684 | A1 * | 10/2006 | Poole | 49/409 |
| 2006/0236613 | A1 * | 10/2006 | Ewing | 49/410 |
| 2007/0113497 | A1 * | 5/2007 | Carless | 52/207 |

FOREIGN PATENT DOCUMENTS

| | | |
|---|---|---|
| DE | 202 15 762 | 1/2003 |
| DE | 202 15 762 | 2/2003 |
| EP | 1 028 214 | 2/2000 |
| EP | 1 028 214 | 8/2000 |

* cited by examiner

REGULATION MECHANISM FOR SLIDING DOORS

OBJECT OF THE INVENTION

The present invention relates to a mechanism allowing regulating the maximum opening of a built-in sliding door.

BACKGROUND OF THE INVENTION

Built-in sliding doors have special interest because they allow gaining more free space than hinged doors. This is due to the fact that the leaf of an open sliding door is totally or partially concealed between the constructive enclosures forming the distribution of the premises.

Generally the lower part of the sliding leaf comprises a guide in which there slides at least one guide that is fixed to the floor. The main function of these guides is to guide the movement of the leaf, always keeping it on the same vertical plane, and therefore preventing blows against the inner faces of the enclosures caused by possible pendular movements.

On many occasions, this type of guide carries out a second function consisting of slowing the introduction of the leaf between both enclosures. On such occasions the guide carrying out said function, called "stop", prevents the leaf from being introduced completely between both enclosures.

The alternative to the stops fixed directly on the floor, such as those that have just been mentioned, are the stops fixed on the upper part of the leaf, generally on the upper securing rails thereof.

In both cases, the position of said stops will depend on aesthetic aspects and on functional aspects relating to the sliding door. The aesthetic aspects mainly come from the visual result of the entire assembly once assembled, depending mainly on the visual aspect caused by the portion of the sliding leaf projecting from the enclosures when the door is completely open. With respect to the functional aspects, a first example would be the presence of handles on the leaf of the door which could collide against the enclosures or be concealed behind them. A second example could be that the enclosures do not conceal the entire leaf and the introduction thereof would have to be slowed to prevent it from colliding against the bottom.

Both described systems have the drawback that once fixed they do not allow adjusting the maximum overlap of the leaf with the enclosures, that is, they do not allow adjusting the maximum opening of the door. That means that any assembly error causing the incorrect operation of the system, or the visual result not being to the satisfaction of the user, will cause having to disassemble the stop and reassemble it in the desired position, with all the drawbacks that this involves.

Furthermore, it is not always evident to identify the correct position of the stop to achieve the desired introduction of the leaf between the enclosures. For that reason, on many occasions such assembly errors occur.

Neither do both described systems facilitate future maintenance or refurbishment tasks, because to carry out such tasks it is necessary to disassemble both the sliding leaves and the stops.

SUMMARY OF THE INVENTION

The regulation mechanism of the present invention resolves in a fully satisfactory manner the technical problems set forth.

To that end and more specifically, the regulation mechanism comprises four key elements:

a cover,
a adjustment screw,
a mobile stop,
a fixed stop.

The cover is the connection element between the sliding leaf and the regulation mechanism of the present invention. For that reason it is fixed at the end of the sliding leaf by means of suitable connection means, such as a plurality of orifices and screws, glue or other adhesive elements. The cover is also an access point through which the elements forming the regulation mechanism can be accessed without needing to disassemble or take out the door.

The cover also comprises a cavity for housing the head of the adjustment screw and an orifice where the other end of said screw is introduced. Said end is housed inside the guide comprised in the lower part of the sliding leaf.

The head of the adjustment screw can be, for example, round, cylindrical or conical, combined with different screwing systems for screwdrivers or Allen wrenches.

To prevent the head of the adjustment screw from coming out of the cavity a bush is arranged in contact with the inner face of the cover with a diameter greater than that of the orifice thereof. Said bush is traversed by the adjustment screw and fixed thereto through fixing means, such as elastic bolts, fixing studs or screws.

The mobile stop is located in the guide and is also traversed by the adjustment screw. The position of the mobile stop is varied by screwing in or unscrewing the adjustment screw in one direction or the other along the stop, moving it further away from or closer to the cover. For that reason the mobile stop comprises a threaded orifice longitudinally traversing it.

The adjustment screw comprises projections at its end preventing the mobile stop from coming out of the same when it moves too far away from the cover.

The mobile stop comprises on its side closest to the cover a housing capable of housing the bush situated close to the head of the adjustment screw. If the adjustment screw is tightened too much when the mobile stop is in contact with the inner face of the cover the bush carries out a second function consisting of preventing possible deformations thereof.

The mobile stop comprises on its side furthest from the cover a piece of rubber protecting it against the blows produced against the fixed stop and eliminating the noise caused by said blows.

The presence of said fixed stop, which slows the introduction of the sliding leaf between the enclosures, is necessary for the mechanism to function correctly.

The present invention uses as a fixed stop one of the guides fixed to the floor of the sliding door itself to maximally reduce the number of components of the regulation mechanism and simplify the assembly thereof. Nevertheless any other independent element fixed in suitable conditions can carry out such a function.

The way to adjust the system is as simple as screwing in or unscrewing the adjustment screw so that the mobile stop moves along it, moving further away or closer to the cover fixed on the sliding leaf. The result of the adjustment is checked by moving the sliding leaf until the mobile stop collides against the fixed stop.

When the mobile stop is in contact with the inner face of the cover of the sliding leaf there is maximum overlap with the enclosures. Therefore there is a maximum area of free passage with the door totally open.

When the mobile stop is at the end of the adjustment screw, slowed by the projections thereof, there is minimum overlap with the enclosures. Therefore there is a minimum area of free passage with the door totally open.

BRIEF DESCRIPTION OF THE DRAWINGS

A series of drawings which aids in better understanding the invention and is specifically related to an embodiment of said invention, which is depicted as a non-limiting example thereof, is described below.

DETAILED DESCRIPTION OF THE PREFERRED EMBODIMENTS

Figure 1:
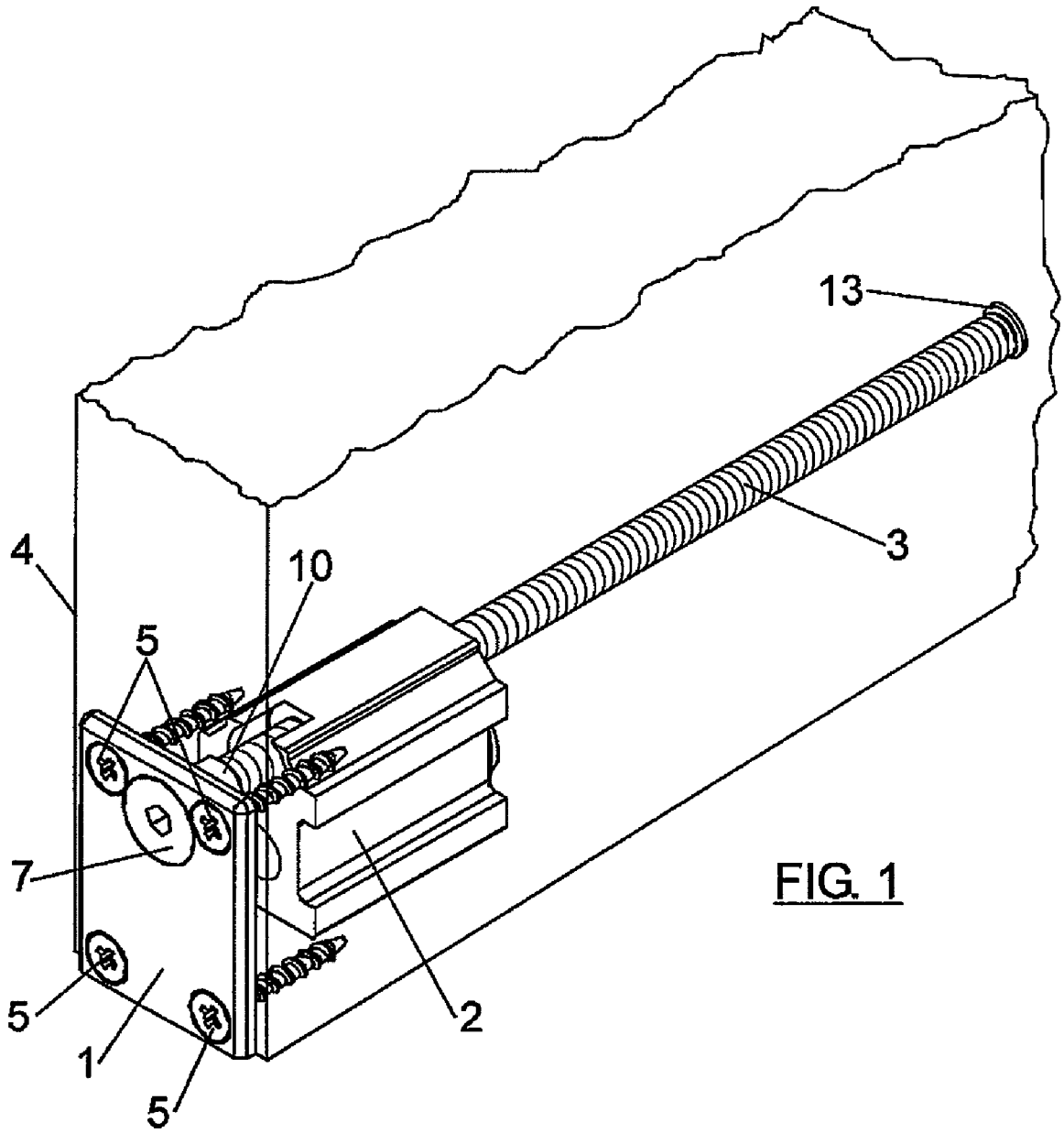
FIG. 1 is a perspective view of the cover, the mobile stop and the adjustment screw.

FIG. 1 shows a perspective view of the main components of the regulation mechanism of the present invention; the cover (1), the mobile stop (2) and the adjustment screw (3).

Figure 2:
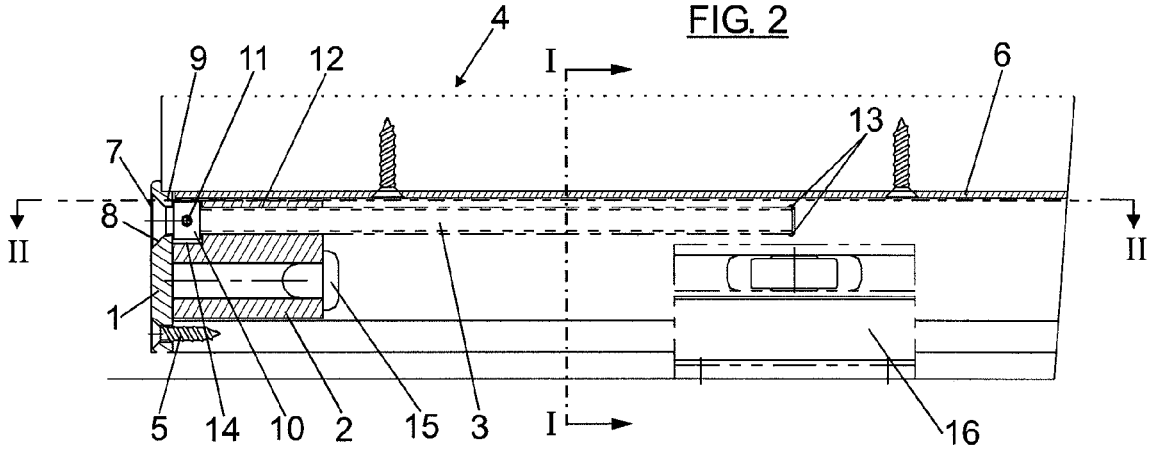
FIG. 2 is an elevated sectional view of the sliding leaf showing the location of the components of the regulation mechanism inside the guide of the sliding leaf.

In the same figure it can be seen that the cover (1) is fixed at the end of the sliding leaf (4) by means of connection means (5), consisting of a plurality of screws, and that the head (7) of the adjustment screw (3) is housed in a cavity (8), FIG. 2, of said cover (1).

FIG. 2 depicts an elevated sectional view of the sliding leaf (4) in which the location of the different components of the regulation mechanism inside the guide (6) of the sliding leaf (4) can be seen.

As can be seen, the cover (1) comprises a cavity (8) for housing the head (7) of the adjustment screw (3) and an orifice (9) where the other end of said screw (3) is introduced. The end of the adjustment screw (3) is housed inside the guide (6) comprised in the lower part of the sliding leaf (4).

To prevent the head (7) of the adjustment screw (3) from coming out of the cavity (8) it has a bush (10) in contact with the inner face of the cover (1) with a diameter greater than the orifice (9) thereof. Said bush (10) is traversed by the adjustment screw (3) and fixed thereto through fixing means (11) consisting of an elastic bolt.

The mobile stop (2) is located in the guide (6) and is also traversed by the adjustment screw (3). The position of the mobile stop (2) is varied by screwing in or unscrewing the adjustment screw (3) in one direction or the other along the stop, moving it further away from or closer to the cover (1). For that reason the mobile stop (2) comprises a threaded orifice (12) longitudinally traversing it.

The adjustment screw (3) comprises projections (13) at its end preventing the mobile stop (2) from coming out of the same when it moves too far away from the cover (1).

The mobile stop (2) comprises on its side closest to the cover (1) a housing (14) capable of housing the bush (10), and on its side furthest from the cover (1) a piece of rubber (15) capable of absorbing the blows and noise produced against the fixed stop (16).

Figure 3:
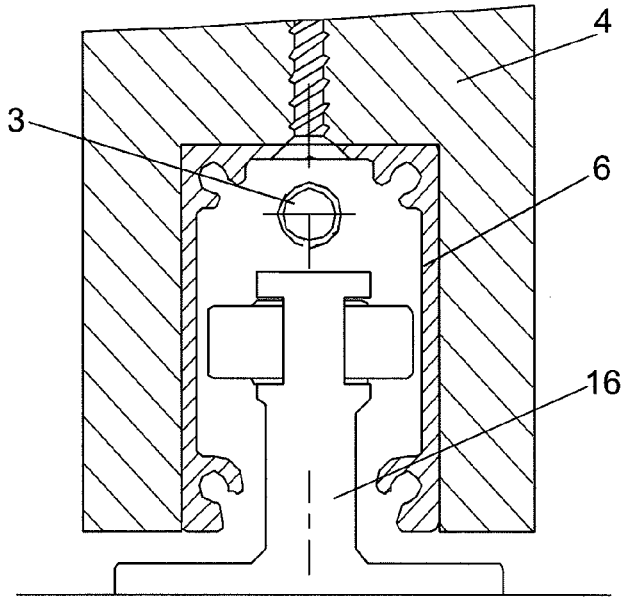
FIG. 3 depicts a sectional view according to the I-I section plane of FIG. 2.

FIG. 3 depicts a section view according to the I-I section plane of FIG. 2 showing the location of the fixed stop (16) inside the guide (6) of the sliding leaf (4).

Figure 4:
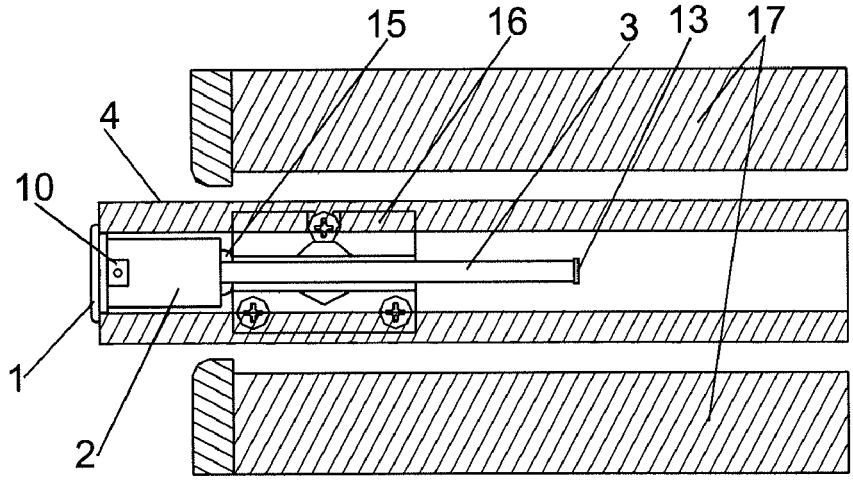
FIG. 4 is a plan sectional view of the sliding door in the position of maximum overlap.

FIG. 4 shows a sectional plan view of the sliding door in the position of maximum overlap with the enclosures (17). In this position the mobile stop (2) is in contact with the inner face of the cover (1). The bush (10) prevents possible deformations in the cover (1) if in this position the adjustment screw (3) continues to be screwed in. The figure also shows how the fixed stop (16) slows the introduction of the sliding leaf (4) between the enclosures (17). It is also observed how the piece of rubber (15) of the mobile stop (2) is in contact with said fixed stop (16).

Figure 5:
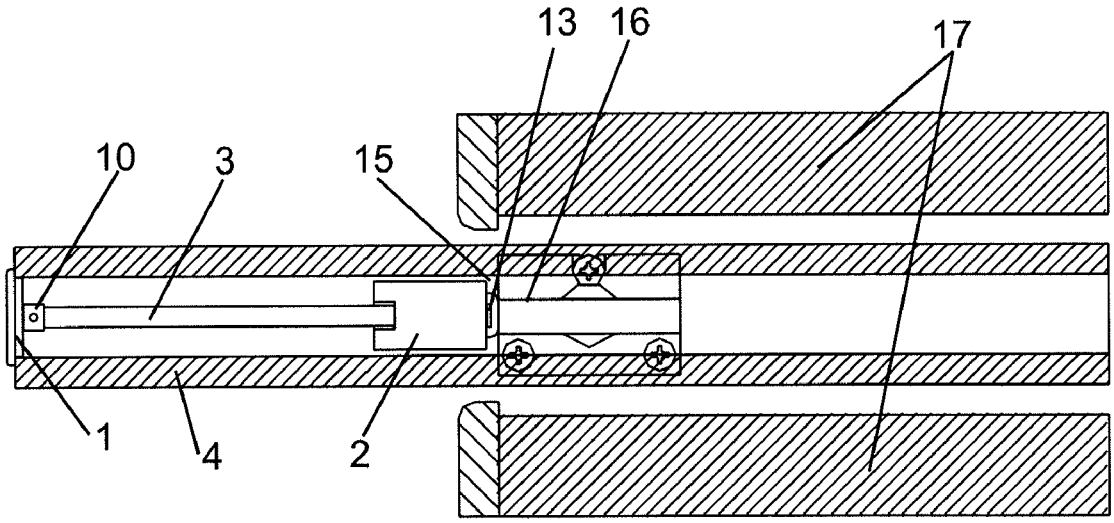
FIG. 5 is a plan sectional view of the sliding door in the position of minimum overlap.

FIG. 5 shows a sectional plan view of the sliding door in the position of minimum overlap with the enclosures (17). In this position the mobile stop (2) is moved as far away as possible from the cover (1) and limited by the projections (13) of the adjustment screw (3). The figure also shows how the fixed stop (16) again limits the introduction of the sliding leaf (4) between the enclosures (17).

Figure 6:
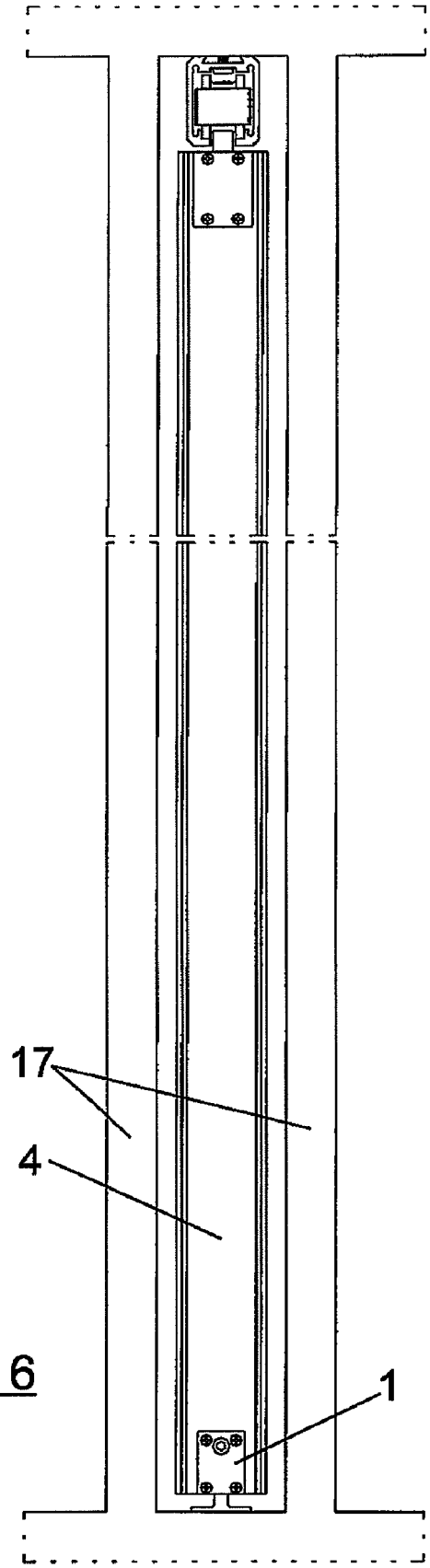
FIG. 6 is a view of the profile of the sliding door and of the enclosures.

FIG. 6 shows a view of the profile of the sliding door in which the location of the cover (1) in relation to the sliding leaf (4) can be seen.

The invention claimed is:

1. A regulation mechanism for sliding doors comprising a sliding leaf, a guide in a lower part of said sliding leaf, and a fixed stop inside said guide, the regulation mechanism comprising:

a cover fixed at the end of the sliding leaf, a mobile stop slidable through an inner part of the guide situated between the cover and the fixed stop, a maximum open position of the sliding door being regulated by contact of the mobile stop with the fixed stop, and an adjustment screw traversing the cover and the mobile stop, the adjustment screw regulating the relative position between the cover and the mobile stop;

a bushing traversed by the adjustment screw and fixed to said adjustment screw by means for fixing between an inner face of the cover and the mobile stop;

wherein the mobile stop comprises a threaded passage traversing the mobile stop longitudinally, a rubber element on a side of the mobile stop furthest from the cover, and a housing for the bushing on a side of the mobile stop closest to the cover.

2. The regulation mechanism for sliding doors according to claim 1, wherein the adjustment screw comprises at one end a head and at the other end projections.

3. The regulation mechanism for sliding doors according to claim 1, wherein the cover comprises a cavity for housing a head of the adjustment screw, an orifice, and means for fixing to the sliding leaf.

* * * * *